United States Patent [19]

Antonious

[11] 4,270,285

[45] Jun. 2, 1981

[54] ADJUSTABLE AND FLEXIBLE SHOE CLOSURE ASSEMBLY AND ELASTIC GORE

[76] Inventor: Anthony J. Antonious, 205 E. Joppa Rd., Towson, Md. 21204

[21] Appl. No.: 1,737

[22] Filed: Jan. 8, 1979

[51] Int. Cl.[3] ..... A43B 11/00

[52] U.S. Cl. ..... 36/50; 36/51; 2/DIG. 6; 24/306

[58] Field of Search ..... 36/50, 51, 54, 128, 36/129; 2/DIG. 6; 24/204, 73 GC

[56] References Cited

U.S. PATENT DOCUMENTS

| | | | |
|---|---|---|---|
| 3,009,221 | 11/1961 | Firari | 36/50 X |
| 3,372,438 | 3/1968 | Rinecker | 24/204 X |
| 3,407,450 | 10/1968 | Baso | 36/50 |
| 3,902,229 | 9/1975 | Doerpinghaus | 24/204 X |
| 4,079,527 | 3/1978 | Antonious | 36/51 |
| 4,126,951 | 11/1978 | Antonious | 36/54 |

FOREIGN PATENT DOCUMENTS

| | | | |
|---|---|---|---|
| 124925 | 11/1901 | Fed. Rep. of Germany | 36/50 |
| 147938 | 1/1904 | Fed. Rep. of Germany | 36/51 |
| 1380027 | 10/1964 | France | 36/51 |
| 1471601 | 1/1967 | France | 36/51 |
| 2271782 | 12/1975 | France | 24/204 |
| 2375841 | 7/1978 | France | 36/50 |
| 430494 | 8/1967 | Switzerland | 36/50 |

*Primary Examiner*—James Kee Chi

*Attorney, Agent, or Firm*—Nicholas J. Aquilino

[57] ABSTRACT

A shoe having an adjustable and flexible closure assembly utilizing separable fastening members having coacting, flexible gripping elements, such as hook and loop Velcro type fastening means in combination with an elastic instep-gore or elastic side-gores. The closure assembly includes an anchor strap having an opening to engage a fastener strap permitting the wearer to easily pull the uppers of the shoe inwardly and simultaneously to the precise desired tautness and fasten the shoe, using only one hand.

32 Claims, 19 Drawing Figures

ADJUSTABLE AND FLEXIBLE SHOE CLOSURE ASSEMBLY AND ELASTIC GORE

FIELD OF THE INVENTION

The present invention pertains to shoes, particularly dress shoes, casual shoes, golf shoes and other sports shoes, boots, slippers, specialized shoes for the handicapped and other footwear.

BACKGROUND OF THE INVENTION

This invention relates to improvements in shoes which can eliminate the use of buckles and other rigid-type fasteners that only provide a predetermined, fixed and limited number of adjustments available to the wearer when fastening the shoe.

Some shoes available currently have a strap and buckle closure which offer only limited tautness because of the predetermined position of the holes in the strap for insertion of the rigid stud or latch of the buckle. To fasten buckle type closures, both hands are needed. When the shoe does not fit properly, the foot may shift back and forth, sideways and up and down in the shoe which can cause blisters, bunions, callouses and other problems which are painful and harmful to the feet.

In my prior U.S. Pat. No. 4,079,527 and 4,126,951 and other copending application, I disclosed various Velcro type closures for fastening shoes to maintain the desired tautness specifically across the instep.

Other U.S. patents, particularly the patent to Shaw No. 3,845,769, show the use of a Velcro fastener in footwear. Shaw discloses a therapeutic boot of essentially unyielding material shaped to fit a limb using a plurality of bands with D-rings located adjacent the split in the bottom which receive the Velcro fastener. This structure pulls the sides of the boot together toward the center split.

However, the shoes utilizing the closure assemblies referred to above are not constructed to function in combination with a non-adjustable elastic gore.

SUMMARY OF THE INVENTION

The present invention relates to shoes utilizing an elastic instep gore or elastic side-gores in combination with an adjustable closure assembly which permits the wearer, using only one hand, to independently control the variable adjustments to obtain the precise tension desired for a specific area of the foot.

This invention offers a new concept for construction of shoes which provide a better way to firmly secure shoes to the wearer's foot, to minimize foot slippage, heel-lifting, sensitive insteps and other foot discomforts, caused by improperly fitting shoes. The improvements of this invention which combine an elastic gore or gores and an adjustable, flexible closure assembly permits the wearer to easily and quickly obtain the precise individual tautness and fit for each foot.

The adjustable closure assembly includes an anchor strap, one end of which is attached to one side of the shoe with the free end of the anchor strap having an opening, D-ring (with our without roll bar), grommet or plate which engages the fastener strap attached to the other side of the shoe. The fastener strap includes a hook and loop Velcro type fastening means enabling the wearer to easily fasten the closure assembly at the desired position of tautness. An elastic means may be used in the closure assembly to provide more flexing action for greater comfort to the foot.

The elastic instep gore connects the shoe quarters at the frontal collar position which provides a non-adjustable tension across the upper instep but predominantly at the ankle area. Alternatively, an elastic side-gore or gores connects the quarter to the vamp to provide non-adjustable tension around the ankle area but predominantly across the instep.

Among the objects of the present invention are the provision of a shoe having an adjustable closure assembly to provide a custom fit and more comfort to the foot of the individual wearer.

DESCRIPTION OF THE PREFERRED EMBODIMENTS

Figure 1:
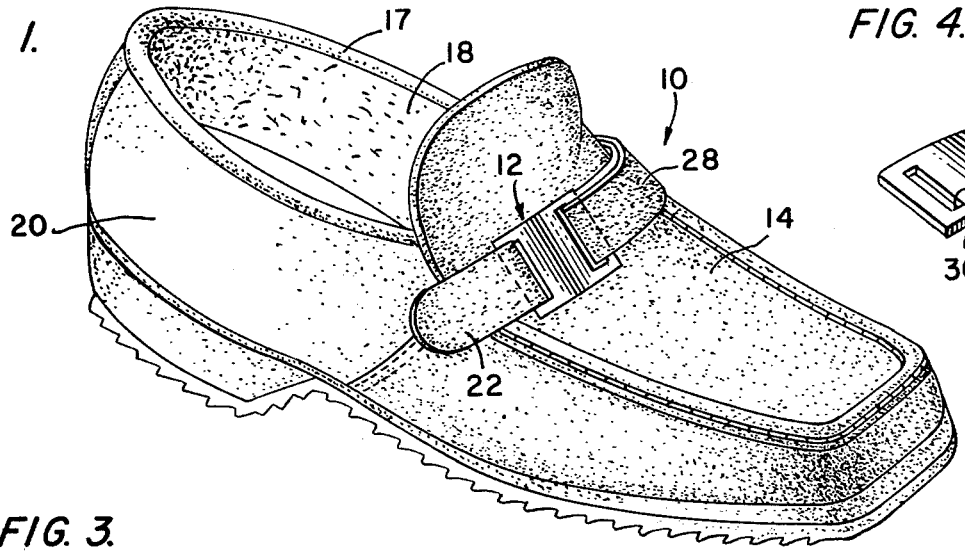
FIG. 1 is a perspective view of one embodiment of a shoe of the present invention showing the closure assembly in the closed position.
Figure 4:
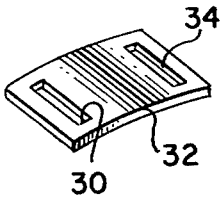
FIG. 4 shows a detail of the shoe of FIG. 1.
Figure 3:
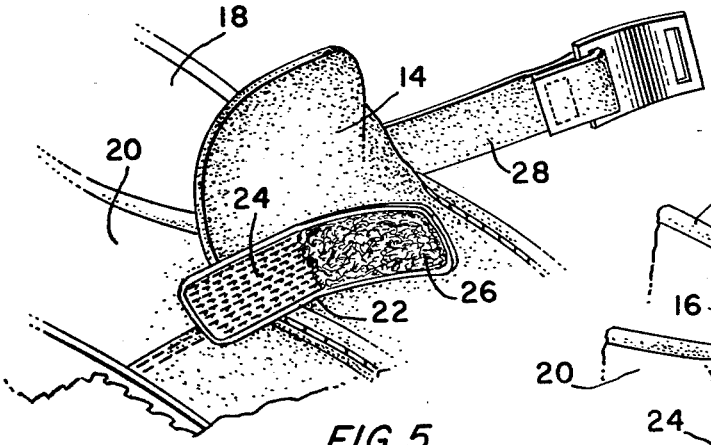
FIG. 3 is a partial perspective view of the shoe of FIG. 1 showing the closure assembly in the open position.
Figure 2:
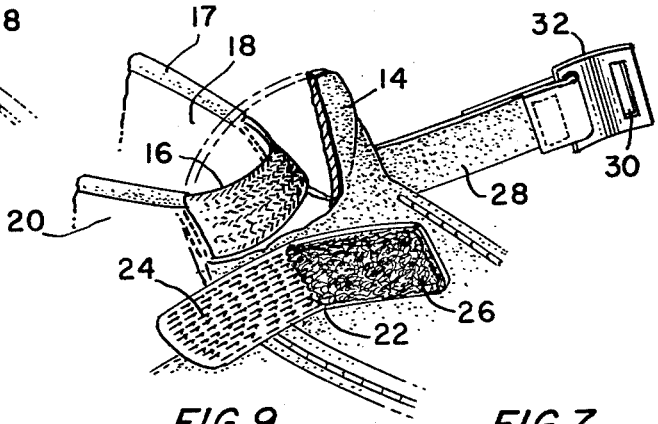
FIG. 2 is a partial sectional view of the shoe of FIG. 1 showing the closure assembly in the open position.

FIGS. 1 to 4 illustrate one embodiment of a shoe 10 of a moccasin-type havng an adjustable closure assembly 12 extending over the vamp 14 from one side of the shoe 10 to the other side of the shoe. The shoe 10 is a type preferably made with an instep gore 16 positioned beneath the vamp 14. The instep gore 16 is made of elastic or some similar yielding material which connects the quarters 18 and 20 of the shoe. The instep gore 16 maintains the shoe collar 17 close to the foot around the ankle area to provide a non-adjustable tension around the ankle. The adjustable closure assembly 12 is formed of a fastener strap 22, which fixed end is secured to the quarter 20 preferably between the vamp 14 and the sole 21 of the shoe 10 by sewing or the like. The flexible and adjustable closure assembly 12 utilizes a flexible, multi-adjustable, separable fastener having first and second fastening members including an array of complementary, coacting flexible gripping elements on each of the members, for example, such as Velcro-type hook and loop separable fasteners. The fastener strap 22 includes a hook and loop type Velcro fastening means formed of a pad 24 of hook type material at the fixed end of the fastener strap 22 and a pad 26 of loop type material formed on the free end of the fastener strap 22. The adjustable closure assembly 12 includes an anchor strap 28 which is secured to the opposite quarter 18 of the shoe 10, the anchor strap 28 having an opening 30 formed by a connector plate 32, shown in detail in FIG. 4, which is secured to the free end of the strap 28. The plate 32 is provided with a second opening 34 which is used to permanently secure it to the free end of the anchor strap 28 by sewing or other securing means.

When the wearer puts the shoe on his foot, he is able to adjust the tautness of the shoe across the instep by using the adjustable closure assembly 12. The free end of the fastener strap 22, having the hook and loop fastening means, is threaded through the opening 30 in order that the hook Velcro pad 24 engages the loop Velcro pad 26 to fasten the shoe. The degree of tautness may be regulated and is universally adjustable by controlling the amount that the fastener strap 22 is pulled through the opening 30 and fastened to the shoe. Thus, with this arrangement, a variety of instep sizes may be comfortably fitted while maintaining the necessary tautness to keep the shoe properly positioned on the wearer's foot. The instep gore 16 maintains tension on the shoe collar 17. With this arrangement, the combination of the instep gore 16 and the adjustable closure assembly 12 provides the necessary tautness at all critical locations where the shoe tends to loosen on the foot of the wearer.

Figure 5:
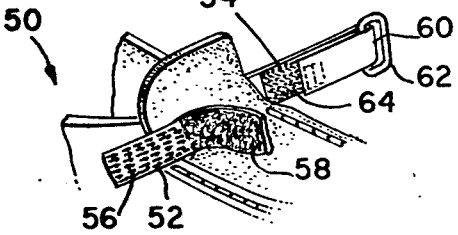
FIG. 5 is a partial view of another embodiment of the shoe of the present invention.

FIG. 5 is a partial view of another embodiment of a shoe 50 of the present invention. An adjustable closure assembly is formed of a fastener strap 52 and an anchor strap 54 secured to the shoe in the same manner as the shoe shown in FIGS. 1 to 4. The fastener strap 52 includes a hook and loop Velcro type fastening means including a hook pad 56 and a loop pad 58. The anchor strap 54 has an opening 60 formed of a D-ring 62 which is secured to the free end of the anchor strap 54. The anchor strap 54 further includes an elastic section 64 positioned on the underside of the free end of the anchor strap 54 and which provides a greater degree of flexibility to the anchor strap 54 as the fastener strap 52 is passed through the D-ring 62 to fasten the shoe.

Figure 7:
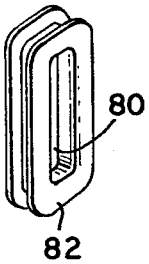
FIG. 7 shows a detail of FIG. 6.
Figure 6:
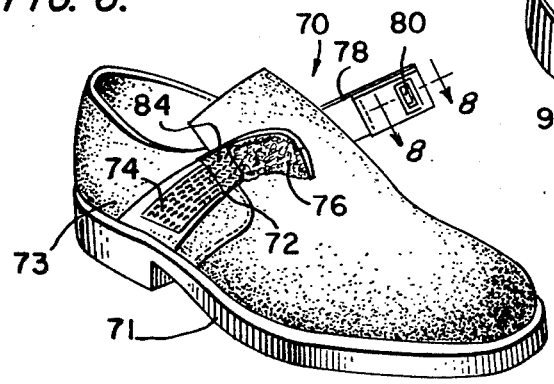
FIG. 6 illustrates still another embodiment of the shoe of the present invention.
Figure 8:
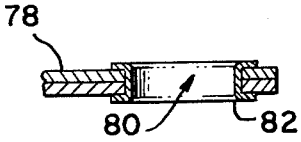
FIG. 8 is a sectional view of FIG. 6 taken along lines 8—8.

FIG. 6 illustrates another embodiment of a shoe 70 of the present invention. An adjustable closure assembly is formed of a fastener strap 72 having a hook and loop Velcro fastening means including a hook Velcro pad 74 and a loop Velcro pad 76 and an anchor strap 78, the free end of which is provided with an opening 80 in the form of a grommet 82 shown in greater detail in FIGS. 7 and 8. The grommet 82 is secured preferably by crimping it to the free end of the anchor strap 78, as shown in FIG. 8. The fastener strap 72 is provided with an elastic section 84 positioned between the hook Velcro pad 74 and the loop Velcro pad 76. The elastic section 84 provides a greater degree of resiliency and flexibility when the fastener strap 72 is passed through the opening 80 to fasten the shoe. The fixed end of the fastener strap 72 is secured to the shoe in the joint where the bottom of the uppers 73 and the sole 71 adjoin.

Figure 9:
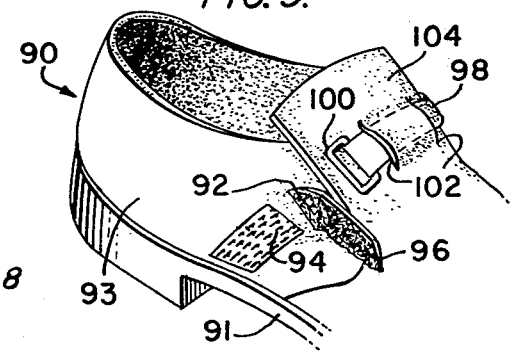
FIG. 9 shows yet another embodiment of the shoe of the present invention.

FIG. 9 shows yet another embodiment of the present invention. A shoe 90 is provided with a adjustable closure assembly including a fastener strap 92 having a Velcro type fastening means including a loop pad 96 and an anchor strap 98 having a D-ring 100. A Velcro hook pad 94, adjacent to but separate from the strap 92, is secured to the shoe between the sole 91 and the top of the shoe uppers 93. In this embodiment, the anchor strap 98 passes through slits 102 in the vamp 104 which maintains the anchor strap 98 in place. The closure assembly is adjusted in the same manner as described hereinabove by passing the free end of the fastener strap 92 through the D-ring 100 to fasten the shoe to the desired tautness as regulated by the wearer.

Figure 10:
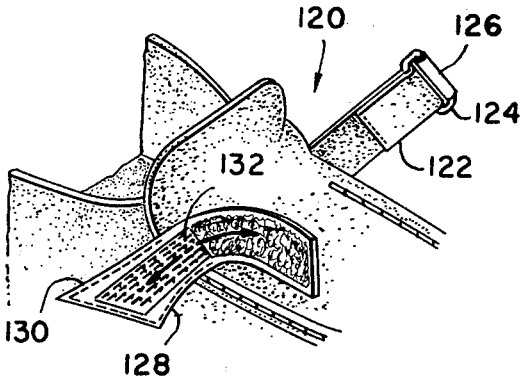
FIG. 10 shows a partial view of another embodiment of the shoe of the present invention.

FIG. 10 illustrates another moccassin type shoe 120 having the adjustable closure assembly of the present invention. An anchor strap 122 is provided with a D-ring type opening 124. The D-ring includes a roll bar 126. The shoe includes a fastener strap 128, the fixed end of which is flared at its base to cover a wider portion of the side of the shoe. The fixed end of fastener strap 128 may be provided with leather trim 130 to also enhance the asthetic appearance of the shoe. The fastener strap 128 is provided with an elasticized Velcro fastener 132 which includes a hook and loop section as described hereinabove.

Figure 11:
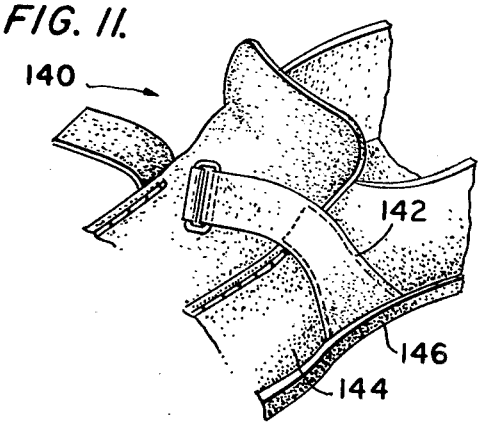
FIG. 11 is a parital view of still yet another embodiment of the shoe of the present invention.

FIG. 11 illustrates a fragmentary view of another shoe 140 having a closure assembly of the present invention wherein the anchor strap 142 is secured at the joint where the quarter of the shoe 144 adjoins the sole 146.

Figure 12:
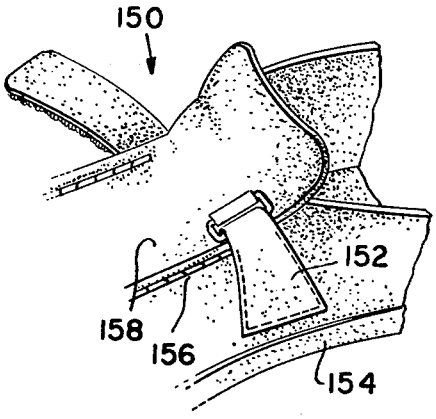
FIG. 12 is a partial view of still another embodiment of the shoe of the present invention.

FIG. 12 illustrates another shoe 150 of the present invention wherein the fixed end of anchor strap 152 is secured between the sole of the shoe 154 and the vamp 158 adjacent the upper end of the quarter 156 of the shoe.

Figure 13:
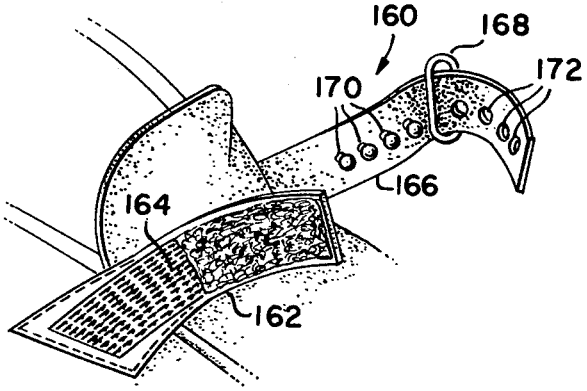
FIG. 13 illustrates another embodiment of the shoe of the present invention.

FIG. 13 illustrates another embodiment of a shoe 160 using the closure assembly of the present invention including a fastener strap 162 having a Velcro type fastener 164 and an anchor strap 166 using a D-ring opening 168. The position of the D-ring 168 may be adjusted along the length of the anchor strap 162 to shorten or lengthen the anchor strap utilizing a series of studs 170 which fit into corresponding holes 172 in the end of the anchor strap 166.

Figure 14:
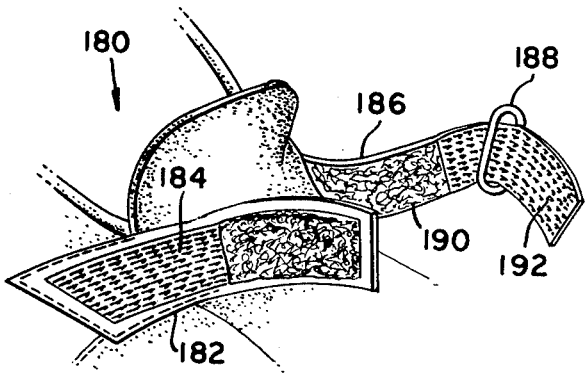
FIG. 14 illustrates still another embodiment of the present invention.

FIG. 14 shows still another embodiment of a shoe 180 using a closure assembly of the present invention including a fastener strap 182 having a Velcro type fastener 184 and an anchor strap 186 using a D-ring opening 188. The anchor strap 186 is provided with a second hook and loop type Velcro fastener formed by hook pad 192 and loop pad 190. The D-ring 188 may be positioned at any location along the length of the anchor strap 186 permitted by the Velcro fastener pads 190 and 192 which coact to hold the D-ring 188 in the desired position as may be required to shorten or lengthen the anchor strap.

Figure 15:
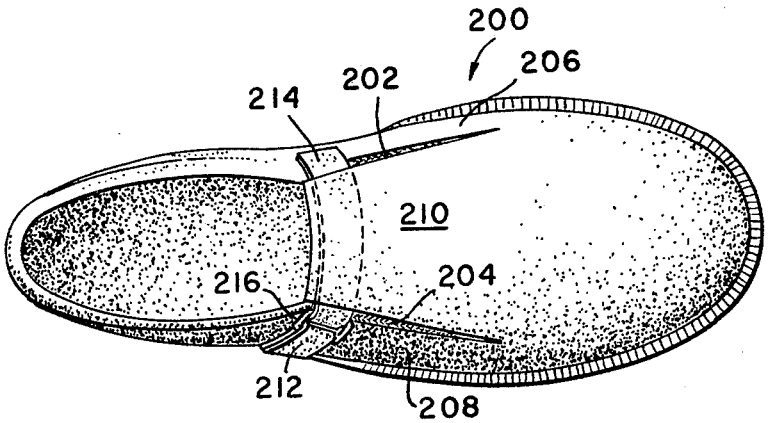
FIG. 15 illustrates another embodiment of the present invention.

FIG. 15 shows another embodiment of a shoe 200 using a closure assembly of the present invention in combination with side gores 202 and 204 located between the shoe uppers 206 and 208 and a vamp 210. The closure assembly includes a fastener strap 212 of the same type as described with respect to the above embodiment including a Velcro type hook and loop fastener. An anchor strap 214 is connected to shoe upper 206 opposite the fastener strap 212. The free end of the anchor strap 214 is provided with a D-ring 216 through which the fastener strap 212 passes to secure the closure assembly. The anchor strap 214 also passes through a tunnel loop formed in the vamp 210 overlying the instep portion of the foot.

Figure 16:
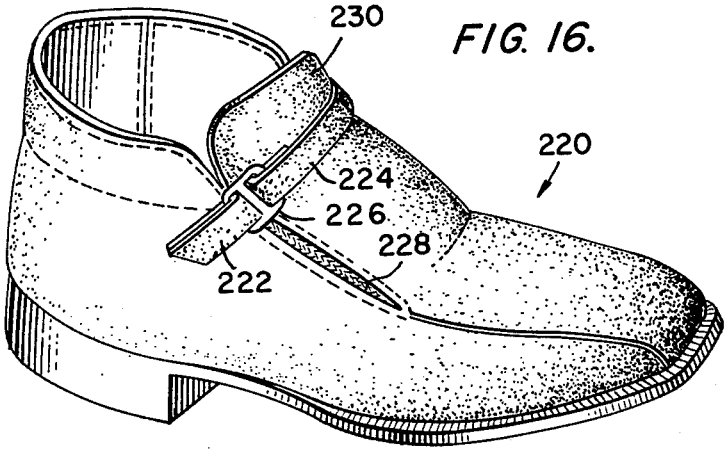
FIG. 16 shows another embodiment of the present invention.

FIG. 16 illustrates still another embodiment of a shoe 220 having a closure assembly formed of a fastener strap 222, anchor strap 224 and a D-ring 226 in combination with side gores 228. In this embodiment, the anchor strap 224 passes over the vamp 230 and is secured on the opposite side of the shoe to the fastener strap 222.

Figure 18:
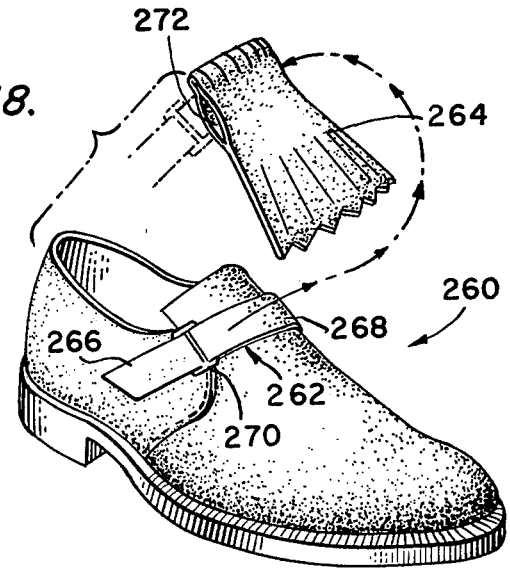
FIG. 18 shows a further embodiment of the present invention.
Figure 17:
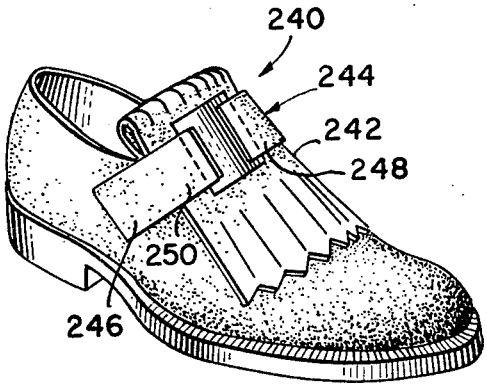
FIG. 17 shows still another embodiment of the present invention.

FIGS. 17 and 18 show additional embodiments of the present invention in combination with a shawl. FIG. 17 shows a shoe in combination with a instep gore, not shown, having a shawl 242 which is an extension of the shoe vamp and is folded over and kept in place by means of closure assembly 244 formed of a fastener strap 246, an anchor strap 248 and a connector plate 250.

FIG. 18 shows a shoe 260 in combination with a closure assembly 262 and detachable shawl 264. The closure assembly includes a fastener strap 266, an anchor strap 268 and D-ring 270. The anchor strap is adapted to fit into a loop opening 272 in the shawl 264 and be positioned by the fastener strap 268 when the closure assembly 262 is secured.

Figure 19:
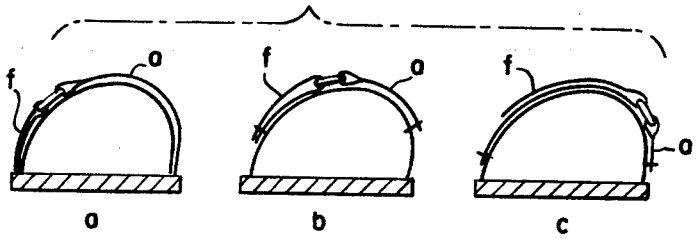
FIG. 19 shows various arrangements of the closure assemblies of the present invention.

FIG. 19 illustrates various arrangements which the closure assembly may take when it is utilized on a shoe. FIG. 19*a* shows a fastener strap f, the fixed end of which is secured at the junction of the sole of the shoe and the shoe upper and which does not extend past the side of the shoe it is secured to. The anchor strap a is secured at the junction of the sole and shoe upper on the other side and extends across the shoe to engage the fastener strap secured over the opposite side of the shoe. FIG. 19*b* illustrates a closure arrangement wherein the fastener strap f is attached above the sole of the shoe and extends partially across the shoe. The anchor strap a is also attached above the sole of the shoe upper on the opposite side of the shoe and extends partially across the shoe to engage the fastener strap. FIG. 19*c* illustrates a closure arrangement wherein a fastener strap f which is secured at a point above the sole and extends across the shoe to the opposite side of the shoe. An anchor strap a is also connected above the shoe sole but remains on that side of the shoe and engages the fastener strap.

These various arrangements in length and location of both the fastener strap and the anchor stap are interchangeable and may be used on any of the embodiments shown in this application as long as the arrangement is consistent with that particular style of shoe.

In all of the above described embodiments, the use of an adjustable and flexible closure assembly on the outside of the shoe combined with an elastic instep gore underneath the vamp or side-gores provides the necessary tautness and adjustability to the shoe to make it comfortable while maintaining its security for a complete range of foot sizes of various wearers.

It will be appreciated that any of the above features may be interchanged with one another without departing from the scope of the present invention. As indicated above, any suitable separable fastener including first and second fastening members having complementary, coacting, flexible gripping elements may be used in place of the hook and loop fastening means specifically described in the specification. Other changes may be made, for example, in either the fastener strap or the anchor strap or both, an elastic section may be used to provide greater flexibility. Various openings, such as a connector plate, grommet or D-ring, may be used in the shoes shown and are readily interchangeable. In addition, elasticized Velcro may be used in any of the embodiments to further increase the adjustability and flexibility of the closure assembly.

What is claimed is:

1. A shoe with a sole and uppers including a vamp and quarters having a collar utilizing elastic gore means connecting said quarters at the frontal collar position in combination with an adjustable and flexible closure assembly which overlays both the instep portion and the upper vamp of the shoe, said closure assembly comprising:

a flexible, multi-adjustable, separable fastener means having first and second fastening members including arrays of complementary, coacting, flexible gripping elements for securing said closure assembly;

a fastener strap secured to said uppers on one side of said shoe, said fastener strap having a fixed portion and a free end, said free end including said first fastening member, said second fastening member positioned adjacent said fixed portion of said fastener strap; and an anchor strap secured to said uppers on the opposite side of said shoe, said anchor strap having a free end with an opening through which said free end of said fastener strap passes permitting adjustment to the precise desired tautness of said closure assembly to fasten said shoe.

2. The shoe of claim 1 wherein said elastic gore means connects said vamp and said quarter to form a side-gore.

3. The shoe of claim 1 wherein said opening is a connector plate.

4. The shoe of claim 1 wherein said opening is a D-ring.

5. The shoe of claim 1 wherein said opening is a grommet.

6. The shoe of claim 1 wherein said anchor strap includes an elastic section.

7. The shoe of claim 1 wherein said fastener strap includes an elastic section.

8. The shoe of claim 1 further including slits in said vamp to position said anchor strap.

9. The shoe of claim 1 wherein said fastener strap is secured to said shoe uppers above the sole.

10. The shoe of claim 1 wherein said fastener strap is secured to the shoe where said uppers and said sole adjoin.

11. The shoe of claim 1 wherein the anchor strap is secured to said shoe uppers above the sole.

12. The shoe of claim 1 wherein the anchor strap is secured to the shoe where said uppers and said sole adjoin.

13. The shoe of claim 1 wherein said fastener strap is attached to one of said shoe quarters.

14. The shoe of claim 1 wherein said anchor strap is attached to one of said shoe quarters.

15. The shoe of claim 1 wherein the fastener strap is attached to both said vamp and one of said quarters.

16. The shoe of claim 1 wherein the anchor strap is attached to both said vamp and one of said quarters.

17. The shoe of claim 1 wherein said anchor strap includes a second adjustable hook and loop fastening means on said strap free end to adjust the length of said anchor strap.

18. The shoe of claim 1 wherein said anchor strap includes an adjustable stud fastener on said strap free end to adjust the length of said anchor strap.

19. The shoe of claim 1 further including a shawl permanently attached to said vamp being positioned by said closure assembly.

20. The shoe of claim 1 further including a detachable shawl having a loop through which said closure assembly passes to position said shawl.

21. The shoe of claim 1 wherein said fastener strap crosses said shoe to engage said anchor strap on the opposite side of said shoe.

22. The shoe of claim 1 wherein said anchor strap crosses said shoe to engage said fastener strap on the opposite side of said shoe.

23. The shoe of claim 1 wherein said fastener strap and said anchor strap extend to engage between said shoe quarters.

24. The shoe of claim 1 wherein said separable fastener means is formed of elasticized material.

25. The shoe of claim 2 wherein said elastic side gore is formed on each side of said shoe.

26. The shoe of claim 2 wherein said vamp includes a tunnel loop through which said anchor strap passes to engage said fastener strap.

27. The shoe of claim 1 wherein said separable fastener means is formed of coacting hook and loop Velcro type fastener pads.

28. The shoe of claim 27 wherein said fastener pad is located adjacent the free end of said fastener strap.

29. The shoe of claim 27 wherein said fastener pad is located adjacent the fixed end of said fastener strap.

30. The shoe of claim 29 wherein said fastener pad is secured to the shoe separately from the fastener strap.

31. The shoe of claim 1 wherein said closure assembly overlies at least a part of said elastic gore.

32. The shoe of claim 1 wherein said arrays of complementary, coacting flexible gripping elements include an array of hook-type gripping elements on said first fastening member and an array of loop-type gripping elements on said second fastening member.

* * * * *